US005141253A

United States Patent [19]

Rice

[11] Patent Number: 5,141,253

[45] Date of Patent: Aug. 25, 1992

[54] SINGLE-SHEET IMAGE CHANGER FOR DISTRIBUTION IN A PUBLICATION BY SECOND-CLASS MAIL

[76] Inventor: Richard Rice, 217 S. Hampton Dr., Venice, Calif. 90291

[21] Appl. No.: 640,940

[22] Filed: Jan. 14, 1991

[51] Int. Cl.[5] ..... B42D 15/00

[52] U.S. Cl. ..... 283/65; 281/15.1; 283/56

[58] Field of Search ..... 281/15.1; 283/65, 56, 283/117

[56] References Cited

U.S. PATENT DOCUMENTS

| | | | |
|---|---|---|---|
| 542,872 | 7/1895 | Craw | 283/56 |
| 1,539,231 | 5/1925 | Armstrong | 283/56 X |
| 4,262,939 | 4/1981 | Schoettle | 283/56 |
| 4,913,694 | 4/1990 | Alphenaar et al. | 283/65 X |

*Primary Examiner*—Paul A. Bell
*Attorney, Agent, or Firm*—Ashen & Lippman

[57] ABSTRACT

This display advertisement qualifies for second-class postal rates because it is all one piece of paper when bound into a publication, when mailed, and when received by a recipient of the publication. Yet it is capable of operation by the recipient to display two or more different images. One area of the sheet forms a slidable-panel portion for motion, eventually, within (or behind) other portions; this slidable-panel portion is folded over to lie within (or behind) the other portions, and connected to the other portions by a perforated tab. The tab initially restrains the slidable-panel portion against actually sliding. The recipient breaks the tab to free the slidable-panel portion, making it actually slidable; and then moves the tab to slide the slidable panel. Preferably the other portions of the sheet are folded and glued to form a flat tube that is tipped (or otherwise bound) into the publication. Parts of images—including photos, lettering, etc.—are formed on upward-facing surfaces of both the top and bottom (i.e., interior) of the tube or of the slidable panel, or preferably of both; and windows are defined in the flat tube—and if desired in the sliding panel as well—to reveal only selected parts of the images, depending upon the position of the sliding panel.

29 Claims, 4 Drawing Sheets

SINGLE-SHEET IMAGE CHANGER FOR DISTRIBUTION IN A PUBLICATION BY SECOND-CLASS MAIL

BACKGROUND

1. Field of the Invention

This invention relates generally to display advertisements for insertion in a publication, such as for example a national publication, that typically and preferably travels by extremely favorable mail rates (namely, second-class rates); and more particularly to such an advertisement that is operable by a recipient of the publication to display a plurality of images.

2. Prior Art

Second-class mail rates are very low, but a publication that is mailed second class is subject to numerous very stringent requirements. One of these requirements is that an insert such as a display advertisement which is bound into the publication must be all one piece of paper.

Postal regulations require, furthermore, that such an insert be all a single piece of paper not only when bound into the publication but also when mailed, and indeed when received by an addressee. Heretofore, this restriction has been considered incompatible with the use of slidable panels that produce an image-changing effect.

Consequently such image changers have not ben considered cost effective or therefore, as a practical matter, feasible for use in publications mailed second class. As a result, advertisers in national publications have largely been denied the attention-getting impact of image-changer display ads.

SUMMARY OF THE DISCLOSURE

My invention is a display advertisement, made substantially of a single unitary sheet of material, for insertion in a publication or the like. It exhibits a plurality of images when operated by a recipient of the publication.

The invention may be seen as having at least two different major aspects—i.e., alternative ways of describing the invention. In one of these aspects, the invention includes a flat glued tube of sheet material, an internal panel of sheet material disposed within the tube, and some means for temporarily securing the internal panel within the tube. The tube and the internal panel are formed, and are bound into a publication, as a single unitary piece of sheet material.

The flat glued tube defines a viewing window. The internal panel is disposed within the tube for shifting between a plurality of positions. The sheet of material also bears indicia, associated with the tube or the panel, or with both, for defining a plurality of images viewable through or adjacent to the window, or both.

The plurality of images corresponds respectively to the positions of the internal panel. In other words, one image can be viewed when the panel is in one position; and another image when the panel is in another position; and so forth.

The means for temporarily securing the internal panel are frangible. For purposes of generality and breadth in describing my invention I shall refer to these means simply as the "frangible means".

The frangible means temporarily hold the internal panel in a substantially fixed position within the tube, for binding and distribution of the publication. The frangible means are manually operable to release the internal panel for shifting.

The foregoing may be a description or definition of the first major aspect of my invention in its broadest or most general form. From what has already been said, it can now be understood that my invention resolves or obviates the above-described constraint upon use of image changers in publications traveling by second-class mail.

As will be appreciated, however, I prefer to practice my invention with certain other features or characteristics that maximize or optimize enjoyment of the benefits of my invention. In particular, I prefer that the frangible means comprise a perforated tab of sheet material that interconnects the internal panel with the tube, before separation at the perforations.

Furthermore the frangible means are preferably formed and bound into the publication as part of the single unitary piece of sheet material. This requirement, however, is not absolute—for postal regulations as interpreted do permit additional elements to be attached to the single unitary piece, provided that some printing appears upon such additional elements.

For example, a cutter string—instead of the perforations mentioned above—may be incorporated into the assembly that is otherwise one single sheet, to sever the sheet, provided that the string is fastened securely in position and has some printing on it. It will be noted that this permissive exception does not affect the requirement that all the paper (or other sheet-material) panels be formed as a single sheet at the time of mailing; the exception deals only with additional elements that may be incorporated into the assembly.

Thus a cutter string or other auxiliary element to facilitate release of the internal panel may be added to the frangible means, if other constraints are also satisfied. At least some part of the frangible means, however, as a practical matter must be unitary and continuous with the internal panel and the tube, so that they in turn can be unitary with respect to each other.

It is for this reason that I prefer simply to perforate the sheet itself to form a perforated tab or interconnection between the internal panel and the tube, since this makes fullest and most economic use of the materials that must in any event be present. It will be understood, however, that use of an additional element may be relatively inexpensive and may enhance some particular thematic element of the advertisement—for example, a slogan such as "We do have strings attached!" or the like.

I also prefer that the glued tube define a slot for manual access to the perforated tab (or other frangible means), to sever the tab at the perforation for separation of the internal panel from the tube, for shifting. In addition I prefer that a portion of the perforated tab provide a tab handle that is aligned with the slot; in this form of my invention, after separation the tab handle is manually slidable through the slot to control the shifting.

I further prefer to include a second viewing window. Unlike the first-mentioned window (which is defined in the tube), this second window is defined in the internal panel. It is partially aligned with the first-mentioned viewing window, when the internal panel is in at least one of its plurality of positions.

Other preferred characteristics or features of the first aspect of my invention will be introduced in following sections of this document. I shall turn now to the second major aspect of my invention.

In this second alternative aspect, the invention comprises a single unitary piece of sheet material. The sheet is initially formed as an array of several sections, which will be described below.

As will be seen, I shall describe relative positions of the various panels or sections that make up the array. Merely for purposes of establishing a geometric frame of reference to use in that description, I shall refer to relative positions of the panels "if the sheet material is generally unfolded".

I intend this phrase only to establish an abstract frame of reference, within which to meaningfully recite relative positions of the panels or sections. I do not mean to suggest that the sheet material must necessarily be partially or fully unfolded, or even unfoldable, at any particular point in the process of producing or practicing my invention.

Being unfolded per se, or even unfoldable, is not a necessary property to effective practice of my invention. To the contrary, my invention is compatible with a very great variety of different conditions such as curvature of the sheet (such as might arise in the use of rotary cutting and printing equipment, for example), as well as prefolding, partial prefolding, gluing or other securing steps, etc., at various points in the production process.

The array formed from a single unitary sheet, in this second aspect of my invention, has at least four sections:

a first section that is near a left rear corner of the piece of material if the sheet material is generally unfolded;

a second section that is immediately adjacent to the first section if the sheet material is generally unfolded, and that has two ends—a first one of the ends being substantially continuous with the first section along a first score or the like for folding;

a third section that is immediately adjacent to the second section if the sheet material is generally unfolded, and that is substantially continuous with a second one of the ends of the second section; and a fourth section that is immediately adjacent to the first section if the sheet material is generally unfolded, and is substantially continuous with the first section along a second score or the like for folding.

In the foregoing subparagraphs, and other portions of this document including certain of the appended claims, I use the phrase "substantially continuous" merely to reemphasize that the sheet material itself is unitary at the boundaries between the sections. This is not to negate the fact that some of the boundaries, being demarcated by scores, perforations, or the like, generally are distorted or even partially discontinuous along the scores, perforations, etc.

In my invention, as considered in this second aspect, the first section serves as a bottom panel of an assembly having three thicknesses, when the display advertisement is completed. The second and third sections together are folded over, along the first score, to lie directly atop the first section and to form the center panel of the three-thickness assembly.

The second section comprises a temporary connection for securing the third section to the first section during assembly and distribution of a publication. The second section defines or carries some means for separation of the third section, with part of the second section, from the first section by a recipient after distribution. Here too for generality and breadth I shall refer to these latter means as the "separation means".

The first or third sections, or both, bear indicia that are facing upward after the second and third sections are folded over atop the first section. The fourth section has at least these characteristics:

(a) It is folded over, along the second score, to lie atop the second and third sections and there form a top panel of the three-thickness assembly.

(b) It is substantially the primary visible panel of the finished advertisement.

(c) It defines two orifices, namely:

a viewing window for viewing a changeable image comprising portions of the indicia on the first or third section, or both; and a slot for access to the second section at the separating means, and for passage of part of the second section after operation of the separating means.

After separation of the third section (with part of the second section) from the first section, the third section is movable rearward or frontward between the first and fourth sections. The recipient accomplishes this by operation of that same part of the second section in or out through said slot in the fourth section.

The foregoing may be a description of the second major aspect of my invention in its broadest or most general form. It can now be appreciated that this second aspect too, even in this general form, resolves the undesirable constraints that are described in the "prior Art" section of this document.

As noted above for the first major aspect of my invention, however, I prefer to practice this second aspect of the invention with certain additional features or characteristics. Such added characteristics or features held to provide fullest enjoyment of the benefits of my invention.

In particular, I consider it preferable that my invention include another viewing window, defined in the third section. This window is for viewing of indicia on the first section.

I also prefer to incorporate a fifth section, immediately adjacent to the first section if the sheet is generally unfolded, and substantially continuous with the second section along a third score or the like. This fifth section is a relatively narrow tab, folded over along the third score, to lie atop the third or fourth section; and is secured by, e.g., glue to the fourth section—so that the first, fourth and fifth sections together form a flat tube generally enclosing the second and third sections.

I furthermore prefer that the third score or the like just mentioned comprise some means for spacing the fifth section slightly away from the first section. By virtue of these "spacing means", the third section moves relatively smoothly within the tube. The third score or the like, for provision of these spacing means, may, e.g., include or take the form of a double score or a double perforation, or a wire bend or the like, as disclosed in greater detail in a later section of this document.

For purposes of the foregoing summary of this disclosure, and for purposes of the appended claims, I define the term "window" to encompass a configuration in which a panel is foreshortened at one end or another—to permit viewing of indicia through the unblocked space, at the end of the panel, that results from the foreshortening. Similarly I define the phrase "within the tube" and equivalent such phrases to encompass a configuration in which part of an element is within and another part of the same element protrudes from the tube.

All of the foregoing operational principles and advantages of the present invention will be more fully appreciated upon consideration of the following detailed description, with reference to the appended drawings, of which:

BRIEF DESCRIPTION OF THE DRAWINGS

In FIGS. 1, 3, 4 and 10, wording that appears in the drawings is not part of the verbal description of this disclosure, but rather is intended as representative of indicia that may actually appear in embodiments of my invention.

Figure 1:
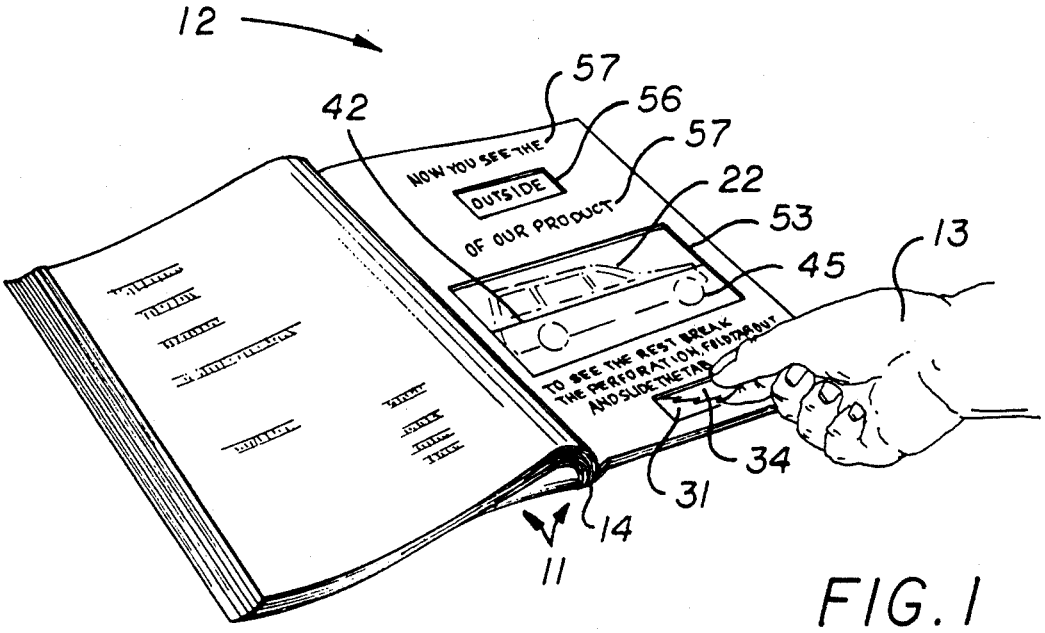
FIG. 1 is a perspective view showing a publication into which is bound a preferred embodiment of my invention. The embodiment is illustrated with the hand of a recipient just in the process of operating the frangible means to separate the internal panel or third section, so that the embodiment is shown while still a single unitary piece of sheet material.

In discussing the several top plan views included in the drawings, and in the corresponding portions of the appended claims, I shall use the following terminology—except to the extent obviously inconsistent with the context. By the term "frontward" I mean "toward the bottom edge of the drawing", the part that is ordinarily nearest the body of the reader; and by "rearward" I mean the opposite direction, namely "toward the top edge of the drawing", the part that usually is farthest from the body of the reader.

By the term "top" or "upper", I mean at or toward the surface of the outer panel that is nearest to and that faces (except in FIGS. 5 through 7, and 9) the reader of this document. (Usually this is also the surface that faces the reader of the advertisement.) By the term "bottom" or "lower", I mean the opposite: at or toward the surface of the outer panel that is farthest from and that faces away from the reader.

Figure 3:
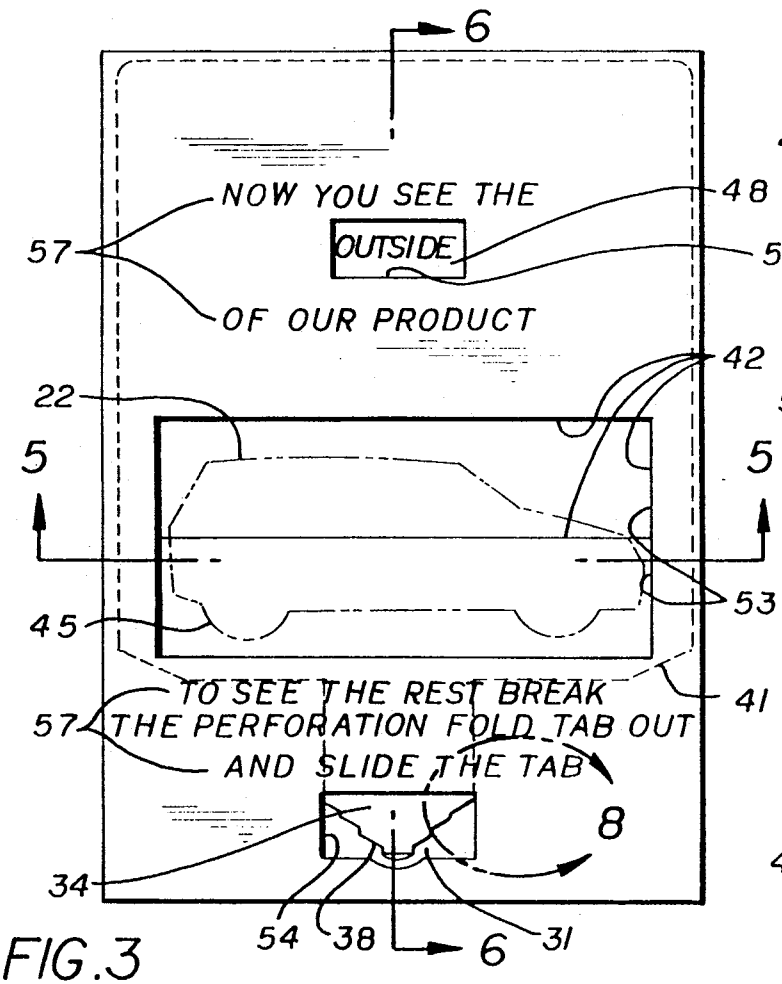

FIG. 3 is a plan view of the same embodiment in the same condition as in FIG. 1, except that the recipient's hand is not shown. The outline of the internal panel or third section appears in the dashed line; and certain indicia that a recipient can see through a large viewing window in the top panel appear in the broken line. The invention as shown here too is still a single unitary piece of sheet material.

Figure 4:
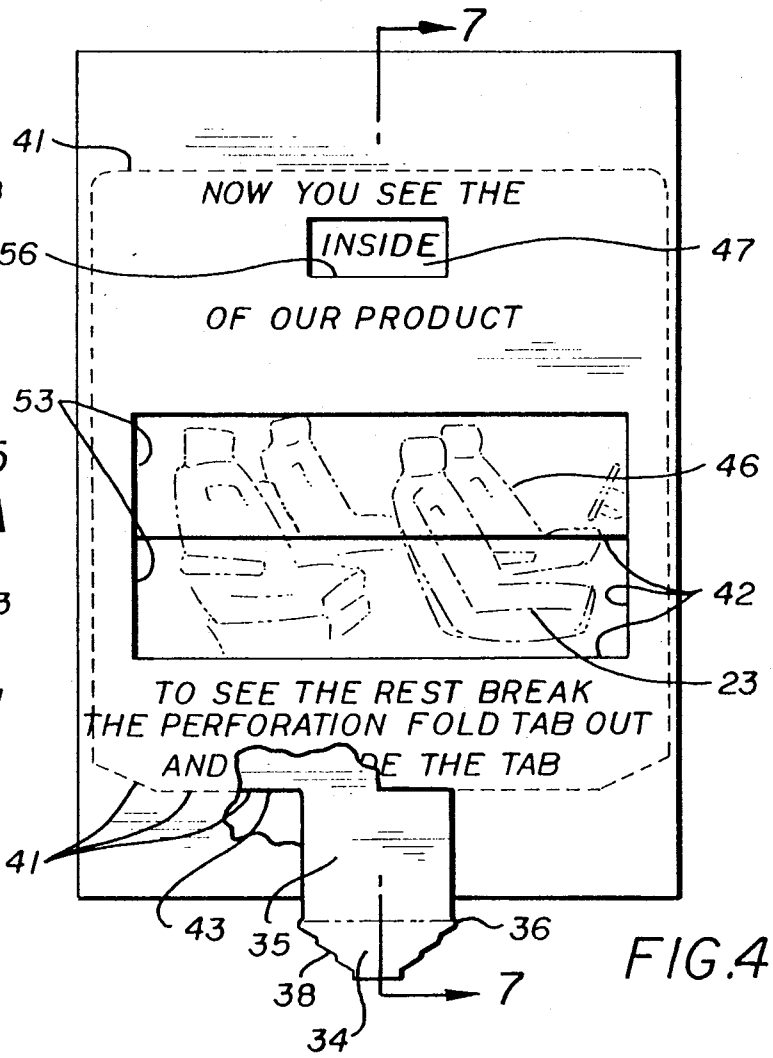

FIG. 4 is a similar view of the same embodiment after operation of the frangible means to separate the internal panel or third section, and with the frangible means also operated frontward to shift or move that panel or section to a different position so that a different image is seen.

Figure 5:
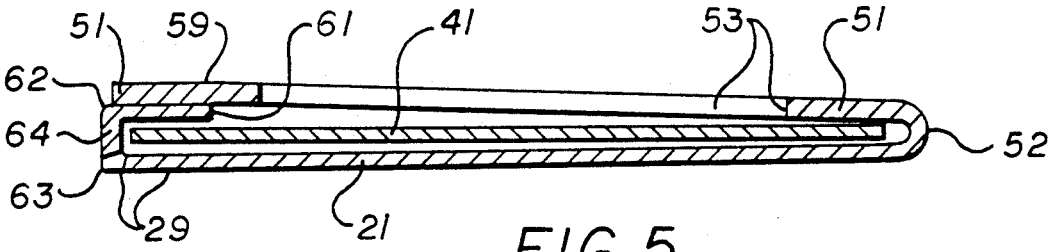

FIG. 5 is a cross-sectional view of the same embodiment taken along the line 5—5 of FIG. 3.

Figure 6:
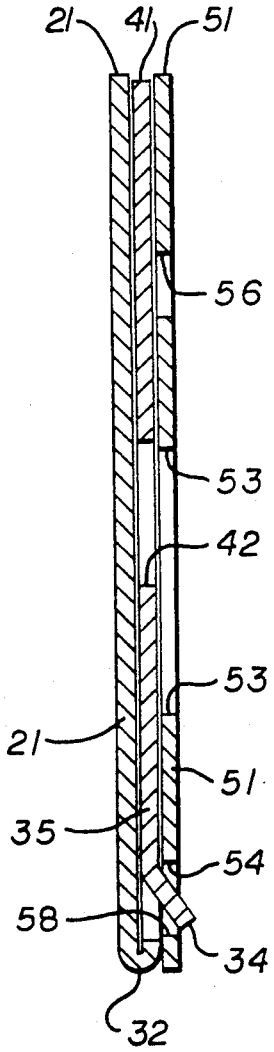

FIG. 6 is a longitudinal section of the same embodiment taken on the line 6—6 of FIG. 3, showing the internal panel or second section still unshifted—but with the frangible means operated to release that panel or section, and folded outward.

Figure 7:
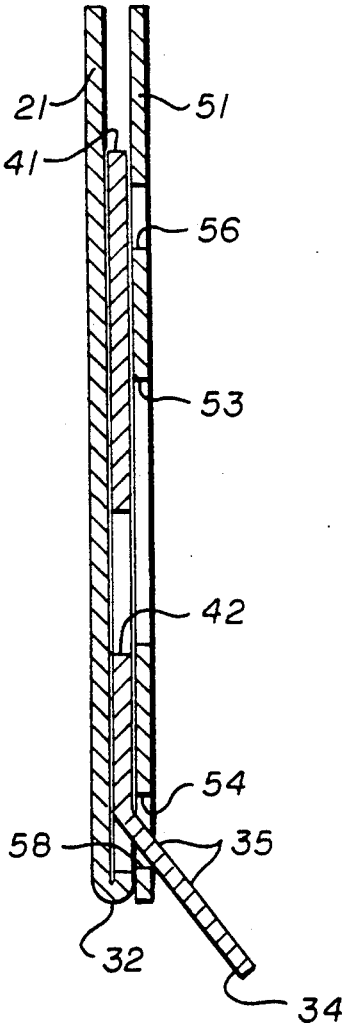

FIG. 7 is a longitudinal section of the same embodiment taken along the line 7—7 of FIG. 4—that is, with the frangible means already operated as shown in FIG. 4.

Figure 8:
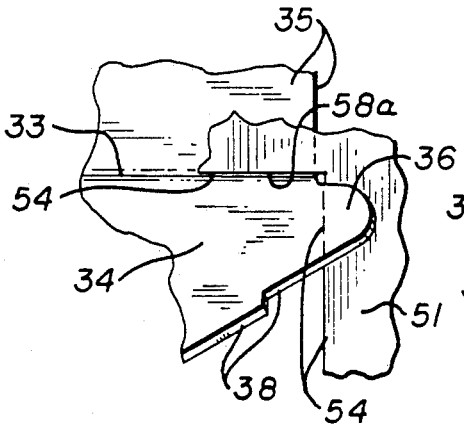

FIG. 8 is a greatly enlarged top plan or perspective view of the area within the arc 8 in FIG. 3, showing the frangible means after they have been operated to separate the internal panel or third section, and with the frangible means angled partly upward the facilitate gripping by the user—but with the frangible means and that panel or section still positioned (or returned) fully rearward.

Figure 2:
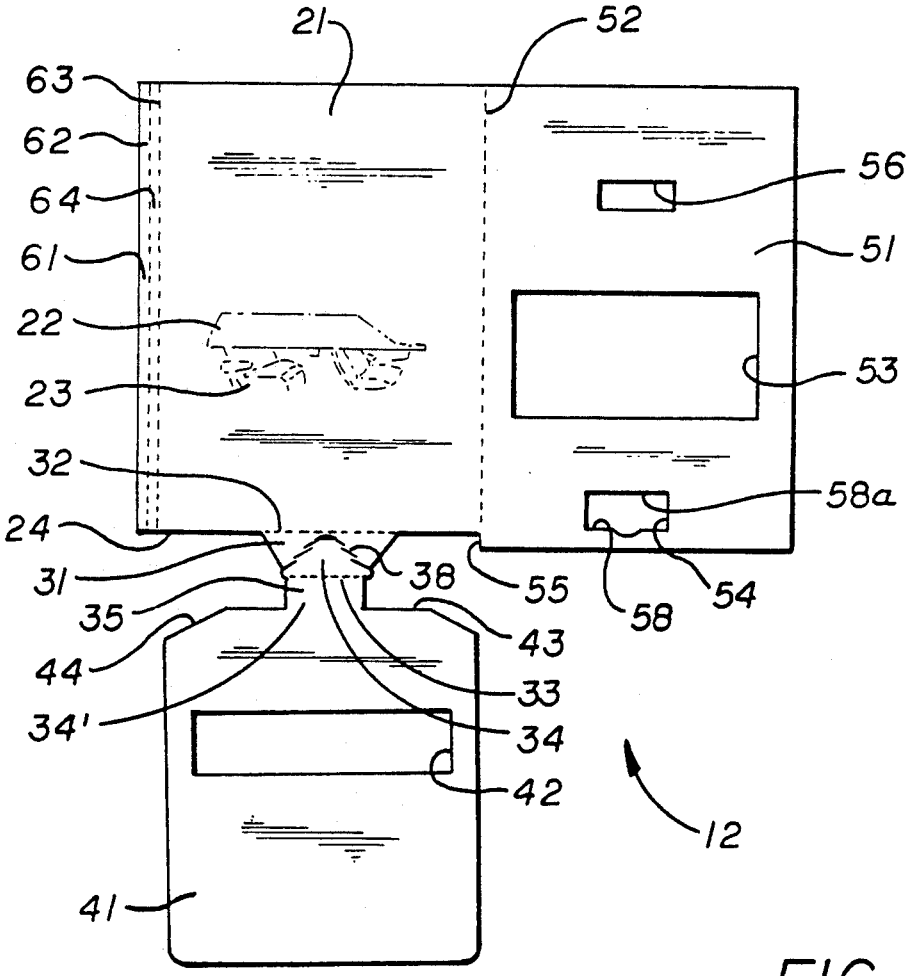
FIG. 2 is a top plane view of the FIG. 1 embodiment with the array of sheet material unfolded flat—for example, prior to being folded.
Figure 9:
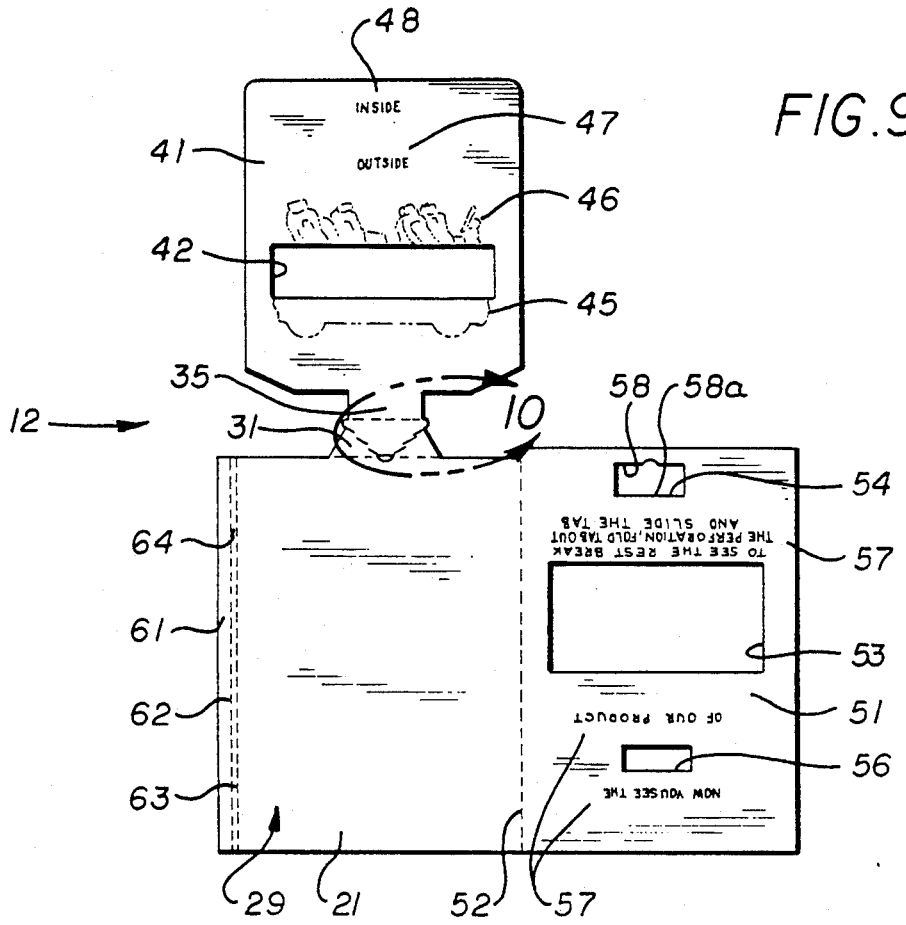

FIG. 9 is a bottom plan view of the same embodiment, in the same condition as in FIG. 2.

Figure 10:
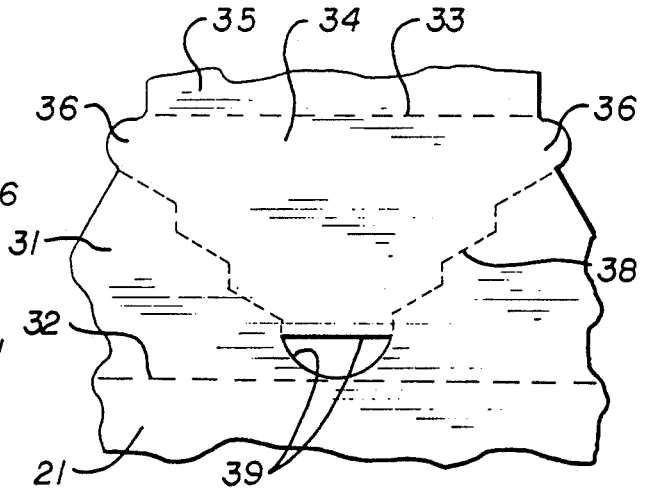

FIG. 10 is a somewhat enlarged top plan view of the area within the arc 10 in FIG. 9, and showing the frangible means before they have been operated to separate the internal panel or third section.

DETAILED DESCRIPTION OF THE PREFERRED EMBODIMENTS

As FIG. 1 shows, a publication 11 can include a display advertisement 12 formed according to a preferred embodiment of my invention—for viewing by a recipient and operation by the recipient's hand 13. The advertisement 12, as constructed according to the following details, is preferably fastened in place by being secured to the top surface of the page that is fastened directly into the binding 14 of the publication 11.

In other words, in the jargon of printing and advertising, the advertisement 12 is "tipped in". As will become clear to those skilled in the art, however, the advertisement 12 can be modified straightforwardly to permit it to be bound into the publication 12 directly if desired.

FIGS. 2 and 9 shows that the advertisement 12 can be made from a single unitary planar blank that is printed, die-cut and scored. These two drawings thus may represent the advertisement 12 at an actual physical stage of fabrication, before folding and gluing.

As mentioned earlier, however, my invention encompasses fabrication of the advertisement in such a way that the construction never passes through the stage shown in FIGS. 2 and 9—i.e., because the blank, due to variant processing sequences that may be employed, is never fully planar while it is in this condition. Even in such a case, nevertheless, these drawings will serve to show the features of the advertisement and what their relative interrelationships would be if the finished advertisement were unfolded (and unglued if need be) and flattened for examination.

The advertisement illustrated is a single unitary piece of sheet material, initially formed as an array of at least four sections. If the sheet material is generally unfolded as shown, the sections are:

a first section 21 that is near a left rear corner of the piece of material.

a second section 31-34-35 that is immediately adjacent to the first section 21, and that has two ends 32, 43' (explained below)—a first one 32 of these ends being substantially continuous with the first section 21 along a first score 32 for folding, a third section 51 that is immediately adjacent to the second section 21, and is substantially continuous with a second one 43' of the ends of the second section 31-34-35, and a fourth section 61 immediately adjacent to the first section 21, and substantially continuous with the first section 21 along a second score 62-63 for folding.

The second end 34' of the second section 31-34-35, although it may appear to be a generally featureless region, is well-defined as the geometric projection of an edge 43 of the third section 41. The meaning of the phrase "substantially continuous" is as previously set forth.

As shown in FIGS. 5 and 6, the first section 21 serves as a bottom panel of an assembly having three thicknesses, when the display advertisement is completed. The second section 34-35 (or 31-34-35 as shown in FIGS. 2 and 9) and the third section 41 together are folded over, along the first score 32, to lie directly atop the first section 21 and to form the center panel of the three-thickness assembly.

The second section 31-34-35 comprises a temporary connection for securing the third section 41 to the first section 21 during assembly and distribution of a publication. This section defines or carries means for separation of the third section 41, with part of the second section 31-34-35, from the first section 21 by a recipient after distribution.

The first section 21 bears indicia 22, 23 that are facing upward initially, and remain facing upward after the second and third sections 31-34-35, 41 are folded over atop the first section 21. Similarly the third section 41 bear indicia 45, 46 that are facing upward after the second and third sections 31-34-35, 41 are folded over atop the first section 21.

The fourth section 51 is folded over, along the second score 52, to lie atop the second and third sections 31-34-35, 41—and there form a top panel of the three-thickness assembly. As can be seen in FIGS. 1, 3 and 4, the fourth section 51 is substantially the primary visible panel of the finished advertisement 12.

Furthermore, the fourth section 51 defines a viewing window 53 for viewing a changeable image 22-45 (FIGS. 1 and 3) or 23-46 (FIG. 4). The image preferably comprises portions of the indicia 22, 23 (FIG. 2) on the first section 21, and portions of the indicia 45, 46 (FIG. 9) on the third section 41, or both.

The fourth section also defines a slot 54 for access to the second section 31-34-35 at the separating means 38, as indicated in FIGS. 1 and 6. This same slot 54 also serves for passage of a part 34-35 (see FIGS. 4 and 7) of the second section 31-34-35 after operation of the separating means 38.

After separation of the third section 41, with that part 34-35 of the second section 31-34-35, from the first section 21, the third section 41 is movable rearward or frontward between the first and fourth sections 21, 51. Motion is produced by operation of that part 31-34 of the second section 31-34-35 in or out through the slot 54 in the fourth section.

The viewing window 53 in the fourth section 51, as noted earlier permits viewing of movable indicia 45, 46 on the shiftable third section or internal panel 41. The effects obtainable in this way are illustrated in a simplified form by the very small additional viewing window 56, which is also formed in the fourth section 51, and which allows viewing of indicia 47 or 48 on the shiftable third panel 41 selectably, depending upon the position of that shiftable panel 41.

I prefer, however, to incorporate also another viewing window 42, defined in the third section 41, for viewing of indicia 22, 23 on the first section. The latter indicia 22, 23 are actually viewed through both the large viewing window 53 in the fifth section and the middle-sized (more specifically, in the illustrated case, half-size) viewing window 42 in the third section, in series. Those two relatively large windows 53, 42 are always aligned for that purpose.

This feature is combined with arrangement of the indicia 22, 23, 45, 46—in a manner known to those skilled in the art—to provide changeable images having rather large area, but with greatly reduced stroke, or shifting distance, of the shiftable internal panel 41. As is also known, multiple slit-shaped windows and several other variants can be employed to obtain full image-changing effects with even further reductions in stroke.

Thus in the illustrated embodiment of my invention the changeable image comprises (a) portions of indicia 45, 46 on the third section 41, viewed through the first-mentioned viewing window 53 in the fourth section 51; and (b) portions of indicia 22, 23 on the first section 21, viewed through both of the relatively large viewing windows 53, 42 in alignment or partial alignment.

The preferred display advertisement 12 further includes a fifth section 61 that is immediately adjacent to the first section 21 in the illustrated condition. This fifth section 61 is substantially continuous with the second section 21, along a third score or the like 62-63 for folding.

The fifth section 61 is a relatively narrow tab, folded over along the third score, to lie atop the third section 41 as illustrated, or (not shown) atop the fourth section 51. In either case it is secured by glue or the like to the fourth section 51 so that the first, fourth and fifth sections 21, 51, 61 together form a flat tube 21-51-61 generally enclosing the second and third sections 31, 41.

As the drawings show, in this preferred embodiment the first score 32 extends in the left-or-right direction; and both the second and third scores 52, 62-63 extend in the front-or-back direction. The second section 31, in the unfolded condition, is toward the front-or-back direction from the first section 21; and the third section 41 is further in the same direction from the second section 31—so that the third section 41 after separation is movable rearward or frontward within the flat tube 21-51-61.

In working with prototypes of my invention, I have found that in such movement the third section 41 is subject to excessive friction along the left edge 62-63 of the tube 21-51-61—that is, the edge which is adjacent to the binding 14 (FIG. 1). Such friction tends to apply torque to, and consequently results in twisting of, the third section 41 within the tube 21-51-61, preventing or inhibiting smooth movement.

I have therefore found it greatly preferable that the third score or the like 62-63 comprise means for spacing the fifth section 61 slightly away from the first section. By virtue of the reduction in friction achieved through this arrangement, the third section 41 moves relatively smoothly within the tube 21-51-61.

I have found that such spacing means are advantageously provided in the form of a pair of closely spaced rows of perforations 62, 63. This structure is drawn in FIG. 5 with one individual perforation 63 interrupting the sheet material locally, but with all the perforations 62 being above or below the plane of the paper in FIG. 5.

These parallel rows of perforations permit formation of two very closely spaced right-angle folds 62, 63 (FIG. 5); and accordingly a very thin intervening strip 64, best seen in FIG. 5. This strip 64 stands off the two adjacent panels 61, 21 slightly from each other.

The arrangement shown provides a fairly strong construction, which minimizes collapse of the left end of the tube under the forces applied during binding and shipment. Satisfactory results might also be obtained by a pair of parallel scores, or by a wire bend—familiar to those skilled in the bindery arts.

Means should also be provided for binding the advertisement into a publication or the like. I prefer to tip the assembly in by gluing it to the next page behind it, along the left edge 29 (FIGS. 5 and 9) of the rear surface of the first section 21. For this purpose, indicia should be omitted from this glue-strip area 29, defined on the first section 21.

If preferred, a glue-strip area 59 (FIG. 5) may instead be formed along the front of the advertisement—for example, along the fourth section 51 as shown, or (with variant folding) the fifth section 61. Because the page immediately above would tend to lie very closely against the top of the advertisement, and thereby obscure the left portion of the front panel 51, I prefer not to use such an arrangement.

I also prefer to inset the first and second scores 32, 52 from the trim dimension of the publication. This feature prevents the panel-interconnecting edges along those scores from being trimmed away with the scrap edges of the publication. Thus all the sections of my advertisement remain a single unitary piece of material after the assembly has been bound into the publication, and after final trimming of the publication.

Along the first score 32, the insetting is provided by a short step 55 (FIG. 2), only about three-eighths of an inch long, to shift that score 32 behind or inside the publication bottom trim. The front panel 51 of the advertisement remains forward, for trimming with the rest of the publication.

Along the second score 52, the inset is provided simply by making the overall width of the assembly (e.g., the width of the first section 21) significantly narrower than the publication trim width. In fact, if as described above the advertisement is tipped into the magazine outside the binding 14, the overall width of the assembly should be narrower than the publication trim width minus the inset of the tipped-in left edge of the advertisement from the outside left edge of the binding.

In the illustrated embodiment of my invention, indicia 22, 23 on the first section 21 advantageously comprise portions of two distinctly different images 22-45 and 23-46 respectively. The third section 41, when released for motion, moves between two positions, which I shall now describe.

In the first of these positions (shown in FIG. 3), substantially only portions 22 of a first one 22-45 of the two images are aligned for viewing through the above-mentioned "other" viewing window 42. In the second position (shown in FIG. 4), substantially only portions 23 of a second one 23-46 of the two images are aligned for viewing through the "other" viewing window 42.

In both positions, the "other" viewing window 42 is aligned behind the first-mentioned viewing window 53 in the fourth section 51, so that all the image portions 22, 23, 45, 46 when aligned for viewing through the "other" viewing window 42 appear through the first-mentioned viewing window 53.

I also prefer to provide indicia 45, 46 on the third section 41. These latter indicia 45, 46 for additional portions of both images 22-45, 23-46.

In particular, portions 45 of these latter indicia 45, 46 form additional portions 45 of the first one 22-45 of the two images. These additional portions are visible through the first-mentioned viewing window 53, with the previously mentioned portions 22 of the first one of the two images, when the third section 41 is in its first position (FIG. 3).

Similarly, other portions 46 of the indicia 45, 46 on the third section 41 form additional portions 46 of the second one 23-46 of the two images. These additional portions are visible through the first-mentioned viewing window 53 with the previously mentioned portions 23 of the second one 23-46 of the two images when the third section 41 is in its second position (FIG. 4).

In addition I prefer that the indicia on the third section 41 further comprise additional image material 47 or 48 (FIG. 9, and FIGS. 1, 3 and 4). This additional image material 47 or 48 is correlated with a particular one 23-46 or 22-45 of the two images respectively.

In this case, the fourth section 51 further defines a third viewing window 56, displaced from the first-mentioned viewing window 51. This third window 56 is for viewing of the additional image material 47 or 48 only when the particular one 23-46 or 22-45, respectively, of the two images is aligned for viewing—i.e., aligned to be seen through the first-mentioned viewing window 56 and through the "other" viewing window 42.

Preferably the slot 54 in the fourth section 51 is narrower than the third section 41 and has an edge 58—namely, the forward edge of the slot 54—that is disposed to halt movement (specifically, forward movement) of the third section 41. The edge 58 halts such movement when the previously mentioned additional portions 46 of the second one 23-46 of the two images are aligned with the first-mentioned portions 23 of that same second image 23-46 (i.e., with portions 23 that are on the first section 21) to form the second image 23-46.

In the illustrated embodiment, the separating means comprise perforations 38 defined in the second section 31-34-35. The perforations 38 at their widest point preferably are slightly wider than the slot 54—being formed into laterally extending ears 36 (FIGS. 8 and 10) that project beyond the side walls of the slot 54.

The slot 54 has another edge **58*a*—the rearward edge of the slot 54—tht is disposed to halt movement (specifically, rearward movement) of the perforations 38-36 and thereby of the third section 41. This other edge 58*a* halts such movement when the additional portions 46 of the first image 23-46 are aligned with the first-mentioned portions 23 of that same first image that are on the first section 21, to form the first image 23-46**.

The ears 38, in order to be extractable through the slot 54 without tearing any part of the assembly except along the perforations 36, must not extend greatly beyond the side walls of the slot. Accordingly these ears 38 alone do not provide much stopping force.

Augmenting the ears 38, however, is the upward-angled triangular forward portion 34 of the tab itself, which as shown in FIGS. 7 and 8 also impinges upon the rearward edge **58*a* of the slot 54 when the tab is moved rearward. As will be appreciated, after breaking the perforations the recipient instinctively tends to angle the triangular forward portion 34** of the tab upward, in order to obtain and retain a firm grip.

As will be appreciated, the stopping of rearward motion is somewhat less critical than the stopping of forward motion. The recipient, upon first receiving the advertisement, can clearly see the first image 22-45 in correct alignment; and then, upon releasing and operating the third panel 41 fully forward against the forward stop, can clearly see the second image 23-46.

Thus the rearwardly stop only serves thereafter as an aid to the recipient who may have enough additional interest in the advertisement to realign the third panel rearward to review the first image 22-45—or perhaps to show it to someone else. At that time, the recipient already has a general idea of the appearance of that first image, and also of the operation of the advertisement—and consequently only needs a slight aid to realignment.

As shown in the drawings, the second section 31-34-35 is a perforated tab of sheet material. It interconnects the third section or internal panel 41 with the flat tube formed by the first, fourth and fifth sections 21, 51, 61—before separation at the perforations 38.

A portion 34 of the frangible means (that is, of this same perforated tab 31-34-35), after being broken, provides a tab handle that is aligned with the slot 58. After separation, the tab handle 34 is manually slidable through the slot 58 to control the shifting of the internal panel 41.

To facilitate the recipient's initial grip on the operating tab 34, before breaking the perforations, I prefer to die-cut and punch out a thumb-hole 39 (FIG. 10). The thumb-hole 39 makes the recipient's use of the tab 34 far easier.

As a practical matter this seemingly very minor feature may actually be quite important, for a typical recipient's initial interest in the advertisement is usually rather slight or superficial. If a protracted, determined, or sophisticated effort were required to release and operate the assembly, in many cases the recipient's initial interest—or level of commitment—would not survive the effort.

Many variations of my invention are within the scope of the claims. Based upon the foregoing disclosure, those skilled in the art will readily visualize a great number of such variations.

For example an internal panel 41 and its second-section attachment 31-35 need not be disposed along the forward edge of the assembly. They may be arranged instead along the rearward edge or elsewhere—even along the right edge (that is, the outer edge of the publication, opposite the binding 14). For such purposes, as those skilled in the art will realize, the four main sections need not be in "L"-shaped array as illustrated, but may instead be in a straing row.

Placement of the second-section attachment near the left edge (near the binding) is possible in principle. Because of operational interference from the binding, however, for most advertising projects it is not highly desirable.

In any of such variations, forward and rearward shifting motion may be retained if desired. If the second section 35 is disposed along the right edge, the connecting tab can, for example,slide forwrd and rearward in a more-elongated slot along the right edge of the assembly. Lateral shifting can be provided instead.

It will be understood that the foregoing disclosure is intended to be merely exemlary, and not to limit the scope of the invention—which is to be determined by reference to the appended claims.

I claim:

1. A display advertisement, made substantially of a single unitary sheet of material, for insertion and binding into a publication; and for mailing, so inserted and bound into such publication, to a recipient of such publication; and exhibiting a plurality of images when operated by such recipient; said advertisement comprising:

a flat glued tube of sheet material, defining a viewing window;

an internal panel of sheet material disposed within the tube for shifting between a plurality of positions;

indicia, associated with the tube or the panel, or with both, for defining a plurality or images viewable through or adjacent to said window, or both, corresponding respectively to the plurality of positions of the internal panel;

frangible means for temporarily securing the internal panel in a substantially fixed position within the tube for binding and mailing of such a publication; said frangible means being manually operable to release the internal panel for said shifting; and means for securing the tube into such publication; and wherein:

the tube, the internal panel and the securing means are formed and are bound for such mailing, as a single unitary piece of sheet material, into such publication.

2. The display advertisement of claim 1, wherein:

said frangible means comprise a perforated tab of sheet material that interconnects the internal panel with the tube before separation at the perforations.

3. The display advertisement of claim 2, wherein: the frangible means are also formed and bound into scuh publication as part of said single untary piece of said sheet material.

4. The display advertisement of claim 2, wherein:

the tube further defines a slot for manual access to the perforated tab, to sever the tab at the performation for separation of the internal panel from the tube for said shifting.

5. The display advertisement of claim 4, wherein:

a portion of the perforated tab provides a tab handle that is aligned with the slot;

wherein after said separation the tab handle is manually slidable through the slot to control said shifting

6. The display advertisement of claim 1, wherein:

the tube further defines a slot for manual access to the frangible means, to operate the frangible means for separation of the internal panel from the tube for said shifting.

7. The display advertisement of clainm 6, wherein: &1 a portion of the frangible means provides a tab handle that is aligned with the slot;

wherein after said separation the tab handle is manually slidable through the slot to control said shifting.

8. The display advertisement of claim 1, wherein the indicia comprise:

indicia formed on a surface of the internal panel, and viewable through the first window when the internal panel is in at least one of said plurality of positions.

9. The display advertisement of claim 1, further comprising:

a second viewing window, defined in the internal panel and partially aligned with said first-mentioned viewing window when the internal panel is in at least one of said plurality of positions.

10. The display advertisement of claim 9, wherein the indicia comprise:

indicia formed on an internal surface of the tube and viewable through both the first and second windows when the internal panel is in said at lest one position.

11. The display advertisement of claim 9, wherein the indicia comprise:

first indicia formed on a surface of the internal panel and viewable through the first window; and second indicia formed on an internal surface of the tube and viewable through both the first and second windows when the internal panel is insaid at lest one position.

12. A display advertisement, made substantially of a single uitary sheet of material, for insertion and binding into a publication and exhibiting a plurality of images when operated bya recipient of the publication; said advertisement comprising:

a single unitary piece of sheet material, initially formed as an array of at least four sections:

a first section that is near a left rear corner of the piece of material if the sheet material is generally unfolded, a second section that is immediately adjacent to the first section if the sheet material is generally unfolded, and that has two ends, a first one of the ends being substantially continuous with the first section along a first score for folding, a third section that is immediately adjacent to the second section if the sheet material is generally unfolded, and is substantially continuous with a second one of the ends of the second section, and a fourth section that is immediately adjacent to the first section if the sheet material is generally unfolded, and is substantially continuous with the first section along a second score or the like for folding;

and wherein:

the first section serves as a bottom panel of an assembly having three thicknesses, when the display advertisement is completed;

the second and third sections together are folded over, along the first score, to lie directly atop the first section and to form the center panel of the three-thickness assembly;

the second section comprises a temporary connection for securing the third section to the first section during assembly and distribution of such publication; and defines or carries means for separation of the third section, with part of the second section, from the first section by such a recipient after distribution;

the first or third section, or both, bear indicia that are facing upward after said second and third sections are folded over atop the first section;

the fourth section (a) is folded over, along said second scorte, to lie atop the second and thiurd sections and tere form a top panel of the three-thickness assembly; (b) is substantially the primary visible panel of the finished advertisement; and (c) defines:

a viewing window for viewing a changeable image comprising portions of said indicia on the first or third section, or both, and a slot for access to the second section at said separating means, and for passage of part of the second section after operation of the separating means; and after separation of the third section, with said part of the second section, from the first section, the third section is movabvle rearward or frontward between the first and fourth sections by operation of said part of the second section in or out through said slot in the fourth section.

13. The advertisement of claim 12, further comprising:

another viewing window, defined in the third section, for viewing of indicia on the first section.

14. The advertisement of claim 13, wherein said changeable image comprises:

portions of indicia on the third section, viewed through said first-mentined viewing window; and portions of indicia on the first section, viewed through both said viewing windows in alignment or partial alignment.

15. The display advertisement of claim 12, further comprising a fifth section that is:

immediately to the left of the first section if the sheet material is generally unfolded;

substantial continuous with the second section along a third score for folding;

a relatively narrow tab, folded over along said third score, to lie atop the second or fourth section; and secured by glue or the like to the fourth section so that the first, fourth and fifth sections together form a flat tube generally enclosing the second and third sections.

16. The display advertisement of claim 15, wherein:

said first score extends in the left-or-right direction;

both said second and third scores extend in the front-or-back direction; and the second section, if the sheet material is generally unfolded, is toward the front-or-back direction from the first section, and the third section is further in the same direction from the second section so that the third section after said separation is movable rearward or frontward within said flat tube.

17. The display advertisement of claim 15, wherein:

the third score comprise means for spacing the fifth section slightly away fron the first section;

whereby the third section moves relatively smoothly within the tube.

18. The display advertisement of claim 15, further comprising:

means defined on the first or fifth section for binding the advertisement into a publication.

19. A display advertisement, made substantially of a single unitary sheet of material, for insertion and binding into a publication, and for forwarding with such publication to a recipient, and exhibiting a plurality of images when operated by such recepient, such publication being characterized by a final trim dimension; said advertisement comprising:

a single unitary piece of sheet material, initially formed as an array of at least four sections:

a first section that is near a left rear corner of the piece of material if the sheet material is generally unfolded, a second section that is immediately adjacent to the first section if the sheet material is generally unfolded, and that has two ends, a first one of the ends being substantialy continuous with the first section along a first score for folding, a third section that is immediately adjacent to the second section if the sheet material is generally unfolded, and is substantially continuous with a second one of the ends of the second section, and a fourth section that is immediately adjacent to the first section if the sheet material is generally unfolded, and is substantially continuous with the first section along a second score or the like for folding;

and wherein:

the first section serves as a bottom panel of an assembly having three thicknesses, when the display advertisement is completed;

the second and third sections together are folded over, along the first score, to lie directly atop the first section and to form the center panel of the three-thickness assembly;

the second section comprises a temporary connection for securing the third section to the first section during assembly and mailing of such publication; and defines or carries means for separation of the third section, with part of the second section, from the first section by such a recepient after mailing;

the first and second scores are positioned so that, when the display advertisement is inserted into such publication, the first and second scores will be inset from such trim dimension of such publication;

whereby all said sections remain a single unitary piece of material after being bound into such publication and after final trimming of such publication;

the first or third section, or both, bear indicia that are facing upward after said second and third sections are folded over atop the first section;

the fourth section (a) is folded over, along said second score, to lie atop the second and third sections and there form a top panel of the three-thickness assembly; (b) is substantially the primary visible panel of the finished advertisement; and (c) defines:

a viewing window for viewing a changeable image comprising portions of said indicia on the first or third section, or both, and a slot for access to the second section at said separating means, and for passage of part of the second section after operation of the separating means; and after separation of the third section, with said part of the second section, from the first section, the third section is movable rearward or frontward between the first and fourth sections by operation of said part of the second section in or out through said slot in the fourth section.

20. The display advertisement of claim 13, wherein:

indicia on the first section comprise portions of two distinctly different images;

the third moves between (a) a first position in which substantially only portions of a first one of said two images are aligned for viewing through said other viewing window and (b) a second position in which substantially only portions of a second one of said two images are aligned for viewing through said other viewing window; and said other viewing window is aligned behind said first-mentioned viewing window in the fourth section, so that all said image portions when aligned for viewing through said other viewing window appear through said first-mentioned viewing window.

21. The display advertisement of claim 20, wherein indicia on the third section form:

additional portions of said first one of said two images, these additional portions being visible through said first-mentioned viewing window with said portions of the first one of said two images when the third section is in said first position; and additional portions of said second one of said two images, these additional portions being visible through said first-mentioned viewing window with said portions of the second one of said two images when the third section is in said second position.

22. The display advertisement of claim 21, wherein:

the indicia on the third section further comprise additional image material that is correlated with a particular one of the two images; and the fourth section further defines a third viewing window, displaced from said first-mentioned viewing window, for viewing of said additional image material only when said particular one of the two images is aligned for viewing through said first-mentioned viewing window and through said other viewing window.

23. The display advertisement of claim 20, wherein:

the slot is narrower than the third section and has an edge that is disposed to halt movement of the third section when said additional portions of the second one of said two images are aligned with the first-mentioned portions of the second one of said two images that are on the first section, to form said second one of said two images.

24. The display advertisement of claim 23, wherein:

the separating means comprise perforations defined in the second section;

said perforations are slightly wider than the slot; and the slot has another edge that is disposed to halt movement of the perforations and of the third section when said additional portions of the first one of said two images are aligned with the first-mentioned portions of the first one of said two images that are on the first section, to form said first one of said two images.

25. The display advertisement of claim 1, wherein:

the securing means substantially constitute a glue strip reserved near an edge of the flat tube, for use in tipping the tube into such publication.

26. The advertisement of claim 25 wherein:

the glue strip is generally without indicia.

27. In combination, for mailing to a recipient:

a publication; and a display advertisement, made substantially of a single unitary sheet of material, inserted and bound into the publication and exhibiting a plurality of images when operated by such recipient ; said advertisement comprising:

a flat glued tube of sheet material, defining a viewing window;

an internal panel of sheet material disposed within the tube for shifting between a plurality of positions;

indicia, associated with the tube of the panel, or with both, for defining a plurality of images viewable through or adjacent to said window, or both, corresponding respectively to the plurality of positions of the internal panel;

frangible means for temporarily securing the internal panel in a substantially fixed position within the tube for binding and mailing of the publication; said frangible means being manually operable to release the internal panel for said shifting; and wherein:

the tube and the internal panel are formed and are bound for such mailing, as a single unitary piece of sheet material, into the publication.

28. In combination, for mailing to a recipient:

a publication; and a display advertisement, made substantially of a single unitary sheet of material, for insertion and binding into the publication and exhibiting a plurality of images when operated by such recipient; said advertisement comprising:

a single unitary piece of sheet material, initially formed as an array of at least four sections:

a first section that is near a left rear corner of the piece of material if the sheet material is generally unfolded, a second section that is immediately adjacent to the first section if the sheet material is generally unfolded, and that has two ends, a first one of the ends being substantially continuous with the first section along a first score for folding, a third section that is immediately adjacent to the second section if the sheet material is generally unfolded, and is substantially continuous with a second one of the ends of the second section, and a fourth section that is immediately adjacent to the first section if the sheet material is generally unfolded, and is substantially continuous with the first section along a second score or the like for folding;

and wherein:

the first section serves as a bottom panel of an assembly having three thicknesses, when the display advertisement is completed;

the second and third sections together are folded over, along the first score, to lie directly atop the first section and to form the center panel of the three-thickness assembly;

the second section comprises a temporary connection for securing the third section to the first section during assembly and mailing of the publication; and defines or carrier means for separation of the third section, with part of the second section, from the first section by such a recipient after mailing;

the first or third section, or both, bear indicia that are facing upward after said second and third sections are folded over atop the first section;

the fourth section (a) is folded over, along said second score, to lie atop the second and third sections and there form a top panel of the three-thickness assembly: (b) is substantially the primary visible panel of the finished advertisement; and (c) defines:

a viewing window for viewing a changeable image comprising portions of said indicia on the first or third section, or both, and a lot for access to the second section at said separating means, and for passage of part of the second section after operation of the separating means ; and after separation of the third section, with said part of the second section, from the first section, the third section is movable rearward or frontward between the first and fourth sections by operation of the said part of the second section in or out through said slot in the fourth section.

29. In combination:

a publication, characterized by a final trim dimension; and a display advertisement, made substantially of a single unitary sheet of material, for insertion and binding into the publication and exhibiting a plurality of images when operated by a recipient of the publication; said advertisement comprising:

a single unitary piece of sheet material, initially formed as an array of at least four sections:

a first section that is near a left rear corner of the piece of material if the sheet material is generally unfolded, a second section that is immediately adjacent to the first section if the sheet material is generally unfolded, and that has two ends, a first one of the ends being substantially continuous with the first section along a first score for folding, a third section that is immediately adjacent to the second section if the sheet material is generally unfolded, and is substantially continuous with a second one of the ends of the second section, and a fourth section that is immediately adjacent to the first section if the sheet material is generally unfolded, and is substantially continuous with the first section along a second score or the like for folding;

and wherein:

the first section serves as a bottom panel of an assembly having three thicknesses, when the display advertisement is completed;

the second and third sections together are folded over, along the first score, to lie directly atop the first section and to form the center panel of the three-thickness assembly;

the second section comprises a temporary connection for securing the third section to the first section during assembly and mailing of the publication; and defines or carries means for separation of the third section, with part of the second section, from the first section by such a recipient after mailing; p1 the first and second scores are positioned so that, when the display advertisement is inserted into the publication, the first and second scores will be inset from the trim dimension of the publication;

whereby all said sections remain a single unitary piece of material after being found into the publication and after final trimming of the publication to said trim dimension;

the first or third section, or both, bear indicia that are facing upward after said second and third sections are folded over atop the first section;

the fourth section (a) is folded over, along said second score, to lie atop the second and third sections and there form a top panel of the three-thickness assembly; (b) is substantially the primary visible panel of the finished advertisement; and (c) defines:

a viewing window for viewing a changeable image comprising portions of said indicia on the first or third section, or both, and a slot for access to the second section at said separating means, and for passage of part of the second section after operation of the separating means; and after separation of the third section , with said part of the second section, from the first section, the third secion is movable rearward or frontward between the first and fourth sections by operation of said part of the second section in or out through said slot in the fourth section.

* * * * *